United States Patent [19]

Borger et al.

[11] Patent Number: 4,995,164

[45] Date of Patent: Feb. 26, 1991

[54] MOTOR-DRIVEN CAN OPENER

[75] Inventors: Georg Borger, Steinbach; Hartwig Kahlcke, Kronberg; Ludwig Littmann, Königstein, all of Fed. Rep. of Germany

[73] Assignee: Braun Aktiengesellschaft, Frankfurt, Fed. Rep. of Germany

[21] Appl. No.: 428,058

[22] Filed: Oct. 26, 1989

[30] Foreign Application Priority Data

Oct. 29, 1988 [DE] Fed. Rep. of Germany ..... 3836925

[51] Int. Cl.[5] ..... B67B 7/46

[52] U.S. Cl. ..... 30/423; 30/424

[58] Field of Search ..... 30/2, 100, 400, 404, 30/405, 423, 424, 433, 444, 421, ; 74/413, 416, 417, 421 K, 421 R, 423

[56] References Cited

U.S. PATENT DOCUMENTS 2,883,745 4/1959 Bristol .
3,075,322 1/1963 Uthoff ..... 30/424
3,675,321 7/1972 Arel .

*Primary Examiner*—Douglas D. Watts
*Assistant Examiner*—Paul M. Heyrana, Sr.
*Attorney, Agent, or Firm*—Fish & Richardson

[57] ABSTRACT

The invention is directed to a can opener (1) having in its casing (2) a drive unit which is comprised of an electric motor (32) secured to a mounting plate (41), a gear train (33) and an output shaft (42) driving the drive wheel (17). The longitudinal axis (8) of the casing (2) along which the electric motor (32), the gear train (33) and the output shaft (42) are arranged forms with the direction determined by the input shaft (70) of the electric motor (32), the shafts (61, 62, 63) of the gear train (33) and the output shaft (42) of the drive wheel (17) an angle (a) which is smaller than 90°.

12 Claims, 4 Drawing Sheets

MOTOR-DRIVEN CAN OPENER

This invention relates to a motor-driven can opener whose cutter assembly is comprised of a drive wheel rotatable about a shaft and operatively associated with a cutter blade, whose casing has on its outside a working surface from which both the cutter blade and the drive wheel project and which includes an electric motor arranged in the interior of the casing, with a gear train which drives the shaft of the drive wheel, with the input shaft of the electric motor, the shafts of the gears of the gear train and the shaft of the drive wheel extending parallel to each other.

An electrically operated can opener of this type is already known from U.S. Pat. No. 3,675,321. According to FIG. 6 of this can opener, the shafts of the gears of the gear train configured as spur gearing extend substantially perpendicularly to the sides of the can opener. In such a type of construction of the drive unit, the overall width of the can opener is substantially determined by the length of the electric motor and the width of the gear train. This means that with specifications such as cutting power, material and power supply given, the dimensions of the electric motor and of the gear train are fixed within predetermined limits, that is, the overall width of the can opener depends substantially on this drive unit. In consequence, relatively amply dimensioned can openers result which are complex and expensive because of their material expenditure alone.

From U.S. Pat. No. 2,883,745, another electrically operated can opener is known in which the electric motor extends in the longitudinal direction of the casing of the can opener (FIG. 3). Mounting the electric motor in the longitudinal direction of the casing results in a compact can opener of small external dimensions. In this can opener, however, it is to be considered less advantageous that the mounting position of the electric motor relative to the drive wheel necessitates an angular gear train which impairs the efficiency of the can opener significantly. This is a particular disadvantage if the can opener is battery-operated, for example; because of the higher energy consumption caused by the angular gear train, the batteries necessarily discharge in a much shorter period. Also, arranging the entire drive unit in the forward area of the can opener—that is, away from the handle—produces an uneven weight distribution, thus requiring an increased holding force on the can opener during the cutting operation.

It is a further disadvantage common to both prior-art can openers that the working surfaces provided by the cutter blade and the drive wheel extend parallel to the sides of the casing. When such can openers are to be used as hand-held devices, for example, particularly long, oval cans such as fish cans may easily strike against the hand holding the can opener, which may be inconvenient for the operator, thus adversely affecting the ease of handling of the can opener.

It is, therefore, an object of the present invention to provide a can opener which affords optimum efficiency compared to can openers of comparable power, which is easy to operate, has small dimensions and low manufacturing cost.

According to the invention, these requirements are satisfied in that the longitudinal axis of the casing along which the electric motor, the gear train and the shaft are arranged forms an angle (a) smaller than 90° with the direction determined by the input shaft of the electric motor, the shafts of the gear train and the shaft of the drive wheel. By arranging the electric motor and the gear train in an inclined relationship to the longitudinal axis of the can opener for the first time, the advantage results that the overall width of the can opener is reduced for a predetermined electric motor and a spur gear train comprised exclusively of spur gears, by inclining this drive unit relative to the longitudinal direction of the casing.

The inclination of the drive unit relative to the longitudinal axis of the can opener depends, however, substantially from the shortest distance (b) between the center axis of the electric motor and the center axis of the shaft of the drive wheel. The greater this distance, the smaller becomes the angle of inclination if the casing dimensions of the can opener are to be maintained unchanged. If the angle of inclination a $=60°$, a particularly compact casing results whose external dimensions are smaller than those of conventional can openers. In this embodiment, dimension (b) is about 65 mm, while dimension (c) which extends in the longitudinal direction of the electric motor between the end of the electric motor on the side remote from the gear train and the end of the gear mounted on the shaft of the drive wheel is 60 mm, approximately.

Because the working surface from which the cutter assembly projects extends parallel to the spur gears of the gear train or perpendicularly to their shafts, it forms an angle (d) of about 30° with the longitudinal axis of the can opener. In the use of a can opener as a hand-held device, this affords the advantage that cans extending beyond the working surface do not reach into the handgrip area so that they do not interfere with the hand holding the can opener.

In order to ensure that in use the point of gravity of the can opener is in the area of a user's hand, an improvement of the invention provides for the casing to extend substantially only over the area covering electric motor, gear train and shaft of the drive wheel, while the casing forms at the same time the handgrip of the can opener. This eliminates the need for additional holding forces which would have to be exerted by an operator if the point of gravity of the can opener was outside the handgrip area, thereby enabling the can opener of the invention to be built to a relatively long dimension without the hand being required to compensate for inconvenient tilting moments.

Because the casing accommodating the drive unit forms at the same time the handgrip, complex manipulating handles additionally provided on the can opener and accordingly cost-intensive are avoided, thus resulting in a casing structure which affords particular ease of manufacture. This is the case in particular if the casing is a cylindrical, preferably circular cylindrical, structure over the entire handgrip area. The circular cylindrical structure permits the use of particularly simple tools for forming out the casing. Also, the circular cylindrical structure of the casing enables the handling of the can opener to be facilitated significantly, because the area of the cylindrical surface of the casing which comes into contact with the hand is particularly large, thus providing a good force distribution and, accordingly, ensuring good handling.

In order to permit a speedy and simple assembly which is also capable of being mechanized, in a further proposal of the invention the shafts of the gear train have their one ends supported in a mounting plate provided with bearing points, while the shafts have their other ends supported in bearing points formed on the casing, with the mounting plate being secured to the casing. The provision of a mounting plate makes it possible to mount the entire drive unit and, where applicable, further components thereon in a prior operation, for subsequent insertion in the casing of the can opener as a complete assembly. Prior assembly of the drive unit avoids the frequently difficult assembly of gear parts and further components in areas of the casing where access is often difficult. The mounting plate further eliminates the need for bearing points on both casing shells for supporting the drive unit. This obviates the considerable expenditure involved in centrally locating the two casing parts relative to the drive unit if the drive unit is directly supported between the two casing shells only. Also, when the can opener is disassembled, the mounting plate ensures that all gears are maintained in a centrally located position on one side, without dropping from the casing. This is a particular advantage for repair work if not parts of the drive unit but rather a completely different component which is not operatively associated with the drive unit has to be replaced.

To limit the number of casing parts required for a can opener to a minimum while at the same time affording a particularly secure and simple fastening of the drive unit in the casing, it is suggested to split the casing into two half shells divided in the longitudinal direction of the can opener and to provide for the mounting plate to be fixedly secured in place by the two assembled casing shells.

A particularly stable and vibration-free fastening as well as a simple centering of the electric motor on the mounting plate are accomplished by centrally locating also the electric motor on the mounting plate by means of a sleeve which is formed on the mounting plate and encloses the motor and by securing the motor to the mounting plate using fastening means. To avoid that in this arrangement the sleeve is mounted on the mounting plate on one side only, in an improvement of the invention the sleeve includes locking means formed at its free end which are adapted to be secured to correspondingly formed recesses in the casing shell. This provides an additional connection between the mounting plate and the casing, avoiding vibrations.

An embodiment of the present invention will be described in more detail in the following with reference to the accompanying drawings. In the drawings, FIG. 1 is a side view looking toward the front of the can opener of the invention;

Figure 1:
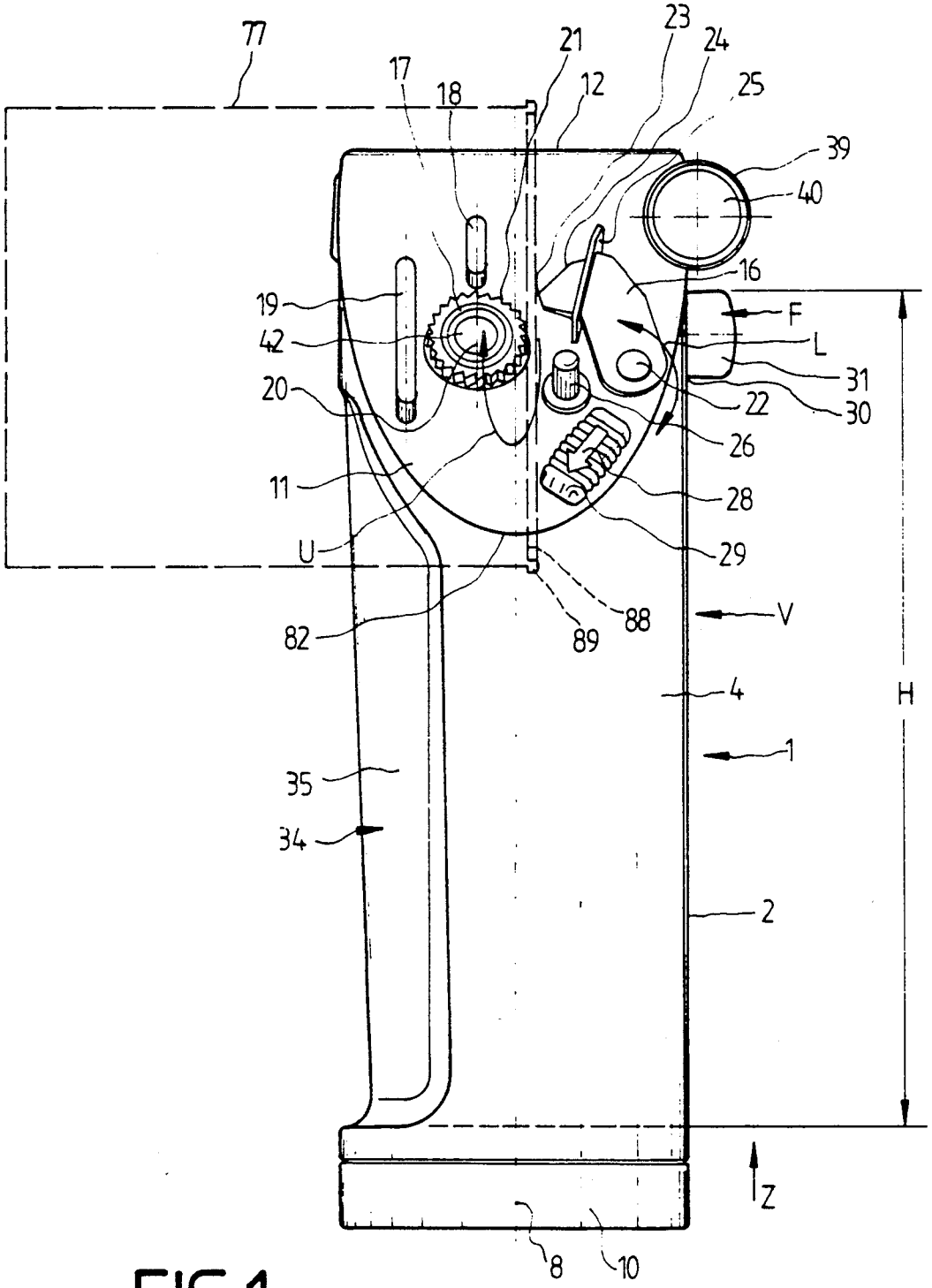
Figure 2:
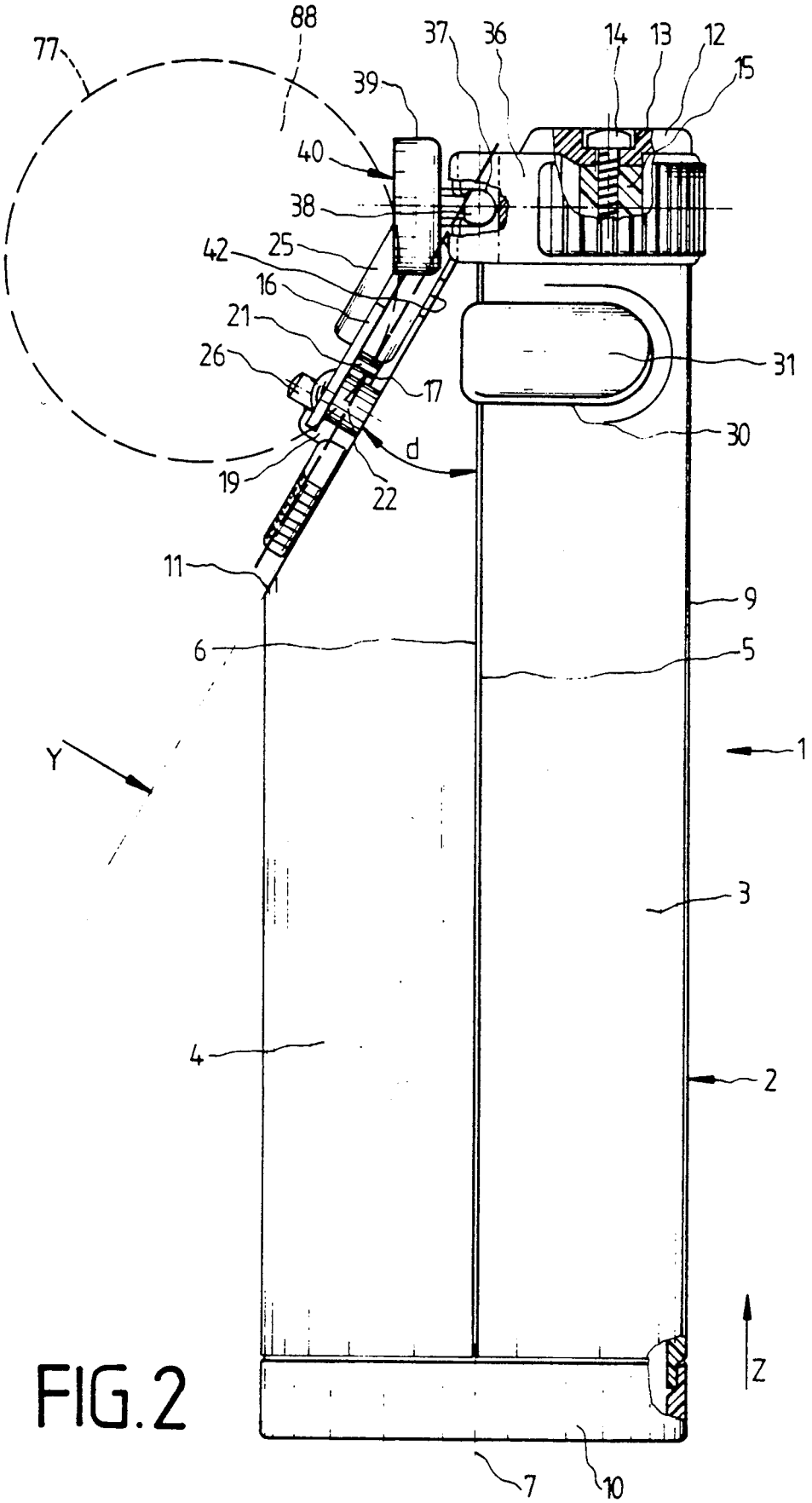
FIG. 2 is a side view looking in the direction of arrow V of FIG. 1.

The can opener 1 of FIGS. 1 and 2 includes a substantially cylindrical casing 2 which is comprised of two separate casing shells 3, 4. The two casing shells 3, 4 form each a half shell joined together on their parting lines 5, 6 (FIG. 2) and extending in the longitudinal direction Z of the can opener 1. In FIG. 2, the longitudinal direction Z extends parallel to the center lines 7, 8 and parallel to the circumferential surface 9 of the two casing shells 3, 4. The two casing shells 3, 4 which form a tube and extend vertically in FIGS. 1 and 2 are sealed at their lower end in FIGS. 1 and 2 by a cap 10 by means of welding, threading or cementing, for example.

Figure 4:
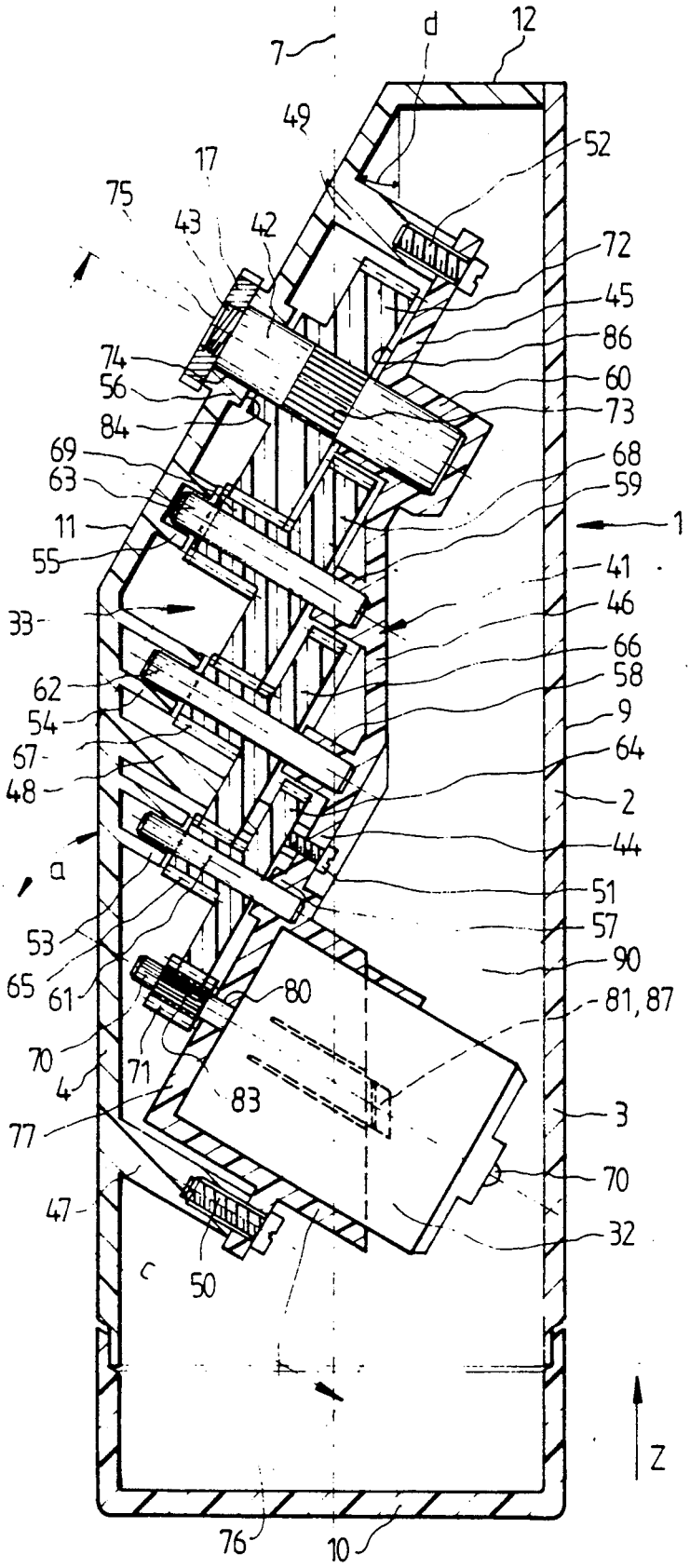
FIG. 4 is a longitudinal sectional view taken along the line III—III of FIG. 3, but with the casing of FIG. 2 enclosing the structure.

In FIGS. 1 and 2, the upper area of the cylindrical casing 2 is chamfered. This chamfer provides the working surface 11 of the can opener 1. In FIG. 2, the working surface 11 forms an angle d of 30° with the center line 7. The working surface 11 begins after approximately two-thirds up to three-fourths of the longitudinal extent of the can opener 1 on the circumferential surface 9 of the casing 2, extending up to about the center of the cover plate 12 which bounds the top of the can opener 1 and extends horizontally in FIG. 2. By cutting through the cylindrical casing 2 on a beveled plane, the outer contour 82 of the working surface 11 traces out a parabolic curve. As shown in FIG. 4, the cover plate 12 is integrally formed with the working surface 11 and the casing shell 4. According to FIG. 2, a stepped bore 13 provided in the cover plate 12 serves to secure the two casing shells 3, 4 in the upper area by means of a screw 14 threadedly engaging in a base 15 connected with the casing shell 3.

In accordance with FIGS. 1 and 2, the cutter assembly comprised of a cutter blade 16 and a drive wheel 17 protrude from the working surface 11. Further projecting from the working surface 11 of FIG. 1 is a stop 19 which extends parallel to the center line 8 and guides the can 77 (shown in broken lines) as the lid 88 is being severed in order to maintain the can 77 in a predetermined angular position relative to the cutter blade 16 to thereby minimize the cutting effort. In FIG. 1, the stop 18 provided on the vertically extending center line 20 of the drive wheel 17 serves to position a can 77 against the drive wheel 17 in such a manner as to ensure a perfect motion of the can 77.

In FIG. 1, the drive wheel 17 has on its outer periphery evenly spaced teeth 21 which during the cutting operation engage under the bead 89 of the can 77 to thereby enable the can 77 to rotate in the direction of arrow U. The cutter blade 16 is adapted to pivot in the direction of arrow L about its pivot 22, this movement being towards or away from the drive wheel 17. In FIG. 1, the center line 8 is approximately the area in which the lid 88 of a can 77 is during a cutting operation, with the lid 88 then extending substantially parallel to the center line 8 and vertically out of the plane of representation of FIG. 1 (neglecting the inclined position of the can caused by the stop 19 or 18).

In FIG. 1, the cutter blade 16 includes a piercing tip 23 and an upwardly adjoining beveled cutting edge 24. A third stop 25 provided on the cutter blade 16 ensures during cutting that the cutter blade 16 bears against the bead 89 of a can 77, thus preventing the blade from penetrating the can lid 88 to an extent greater than absolutely necessary. The third stop 25 further serves the purpose of ensuring that the force of pressure exerted on a can 77 during cutting is transmitted through the bead 89 to the drive wheel 17, causing the can 77 to rotate in the first place—such rotation being further required to be as even as possible.

Between the pivot 22 and the teeth 21 closest to the pivot 22 (in FIGS. 1 and 2), a fourth stop 26 in the form of a pin projects from the working surface 11, preventing the can 77 from turning away in counterclockwise direction about the bearing point 27 provided according to FIG. 1 between the can 77 and the drive wheel 17 during the piercing and cutting cycle. The fourth stop 26 is formed fast with the cover plate 12.

In FIG. 1, an operating button 29 provided with an arrow 28 is formed below the stop 26 which on actuation in the direction of the arrow 28 enables the cutter blade 16 to be removed from the can opener 1 perpendicularly to the working surface 11 out of the plane of the drawing, to be exchanged for an other, sharper blade or to be cleaned from food particles, if necessary. Accordingly, a resilient engaging means, not shown in the drawing, is formed on the operating button 29 which engages radially from the outside into a groove, likewise not shown, in the pivot 22, thus holding the cutter blade 16 captive.

It will further become apparent from FIGS. 1 and 2 that a control button 31 extends radially from an aperture 30 provided on the casing shell 3, which control button is connected with the cutter blade 16 by means of a lever mechanism not shown in the drawing in such a manner that actuation of the control button 31 in the direction of arrow F causes the cutter blade 16 to pivot about its pivot 22 towards the drive wheel 17 until the piercing tip 23 is in abutment with the surface of the lid 88 of a can 77. On further operation of the control button 31 in the direction of arrow F, a resilient element (not shown) provided in the transmission path between the control button 31 and the pivot 22 enables the control button 31 to be moved further without causing a further pivotal movement of the cutter blade 16, in order to increase the pressure of the piercing tip 23 on the can lid 88 and to actuate an electric switch (not shown) in the casing 2 which then energizes the electric motor 32, causing via the gear train 33 (FIG. 3) the drive wheel 17 to start rotating in the direction of arrow U. Without requiring a further force to be exerted on the control button 31, the cutter blade 16 automatically cuts into the can lid 88 as a result of the frictional force ensuing between the can lid 88 and the piercing tip 23, performing a pivot motion until the stop 25 abuts the bead 89 from above.

For improved manipulation of the can opener 1, a recess 34 is provided in FIG. 1 on the casing shell 4 in the left-hand area between the working surface 11 and the cover 10, the circumferential surface 35 of which recess extends likewise concentrically with the center line 8.

In FIGS. 1 and 2, a supporting structure 36 is mounted on the circumferential surface 9 of the casing shell 3 in the upper area above the cutter blade 16, said supporting structure carrying a ball 38 in a calotte 37 provided on the end closer to the working surface 11, said ball 38 having a rotatable sleeve 39 secured thereto which is adjacent to the end of the supporting structure 36 and has a magnet 40 secured in its free space. In FIG. 1, the pivot direction of the supporting structure 36 extends concentrically with the center line 8 of the casing 2, permitting pivotal movement in the circumferential direction of the casing 2 towards the center line 8 at least to such an extent that following severance of the can lid 88 from a can 77 the former is held by the magnet 40. This eliminates the need for ancillary tools otherwise used for the awkward procedure of lifting the can lid 88 out of the can 77. At the same time, the supporting structure 36 prevents the can lid 88 from submerging in the contents of the can 77, so that contaminants, if any, on the top of the can lid 88 cannot come into contact with the food in the can 77.

To open a can 77, the operator holes the can opener 1 in horizontal position as shown in FIG. 2. It will be seen that in this position the working surface 11 extends normal to the plane of the drawing, defining with the center line 7 an angle d which in the embodiment of FIGS. 1 to 4 is 30°, approximately. An oblong flat can, such as a fish can, which according to FIG. 2 protrudes downwardly over the working surface 11, is thereby prevented from coming into contact with a hand (not shown) gripping the can opener 1.

Figure 3:
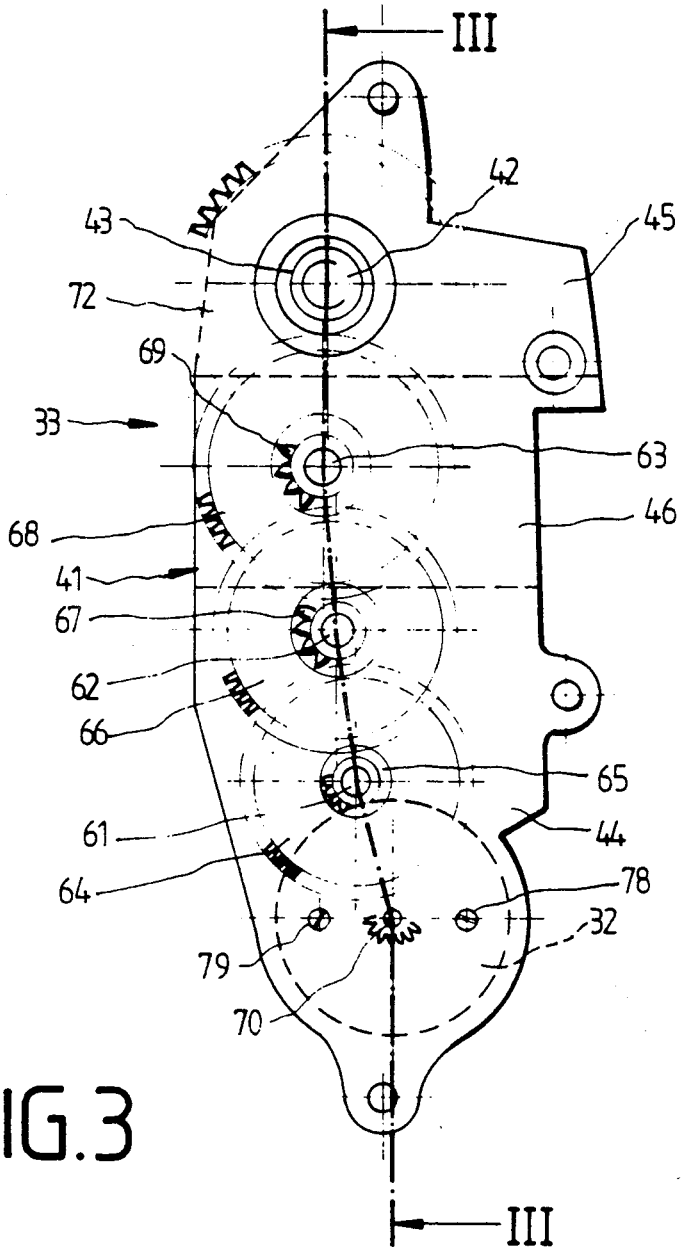
FIG. 3 is a top plan view of the drive unit looking in the direction of arrow Y, with the casing shells removed.

In FIG. 4, the longitudinal sectional view of the can opener 1 taken along the line III—III of FIG. 3 shows, as in FIG. 3, the drive unit secured to a mounting plate 41 in the casing 2 and substantially comprising an electric motor 32 and a gear train 33 having mounted on its output shaft 42 the drive wheel 17 illustrated in FIGS. 1, 2 and 4 by means of a left-hand thread 43.

For improved clarity of the invention, all other components projecting from the working surface 11 as, for example, the parts 16, 18, 19, 26, 39, 40 and 29, are not shown in FIG. 4. To avoid repetitions, parts corresponding to those illustrated in FIGS. 1 and 2 have been assigned identical reference numerals in FIGS. 3 and 4.

In FIGS. 3 and 4, the mounting plate 41 is comprised of two parallel plate members 44, 45 arranged in two planes which are in relative positive engagement by means of a plate-shaped bridge member 46. As shown in FIG. 4, the plate members 44, 45 extend parallel to the working surface 11, while the bridge member 46 extends parallel to the circumferential surface 9 or the center line 7 of the casing 2 of the can opener 1. As the casing shells 3,4, the mounting plate 41 is made of plastic.

In FIG. 4, extending from the bottom of the casing shell 4 into the casing interior 90 perpendicularly to the working surface 11 are columnar foot projections 47, 48 and 49 having free ends upon which the mounting plate 41 takes support and by means of which the mounting plate 41 is secured to the casing shell 4 using screws 50, 51 and 52. Further, bearing shells 53, 54, 55 and 56 configured as sleeves are provided on the inside of the casing shell 4. Opposite the bearing shells 53 to 56, the mounting plate 41 has formed thereon corresponding bearing shells 57, 58, 59 and 60 which are arranged concentrically and in alignment with the opposite bearing shells 53, 54, 55 and 56. The bearing shells 53 to 60 extend normal to the working surface 11. In the mutually corresponding bearing shells 53, 57 and 54, 58 and 55, 59, shafts 61, 62 and 63 are carried each having mounted thereon a respective pair of spur gears 64, 65 and 66, 67 and 68, 69 with involute gear tooth profile (spur teeth) on their peripheries. The respective pairs of spur gears 64, 65 and 66, 67 and 68, 69 are constructed of plastic forming each an integral molding.

In FIGS. 3 and 4, the spur gear 71 which drives the gear train 33 and whose teeth are in engagement with the spur gear 64 is mounted on the input shaft 70 of the electric motor 32 by means of meshing teeth 83 in a manner preventing rotation and axial displacement. Spur gear 65 is in engagement with spur gear 66, and spur gear 67 is in engagement with spur gear 68. The spur gear 69 which is formed on the spur gear 68 provides the driving element for the spur gear 72 which is connected therewith in a non-rotating relationship by means of splines 73 formed on the shaft 42.

According to FIG. 4, the shaft 42 projects outwardly of the casing 2 through a bore 74 formed in the working surface 11. Outside the casing 2, a pin 75 of reduced diameter is formed on the shaft 42, with a thread 43 being provided on the pin periphery. As a result of the increasing torque from the input shaft 70 to the output shaft 42—by contrast, the rotational speed decreases, the reduction ratio being 300:1—and a corresponding increase in the radial loading, the diameters of the shafts 61, 62, 63 as well as of the output shaft 42 are progressively greater from bottom to top in FIG. 4. The same applies to the dimensioning of the spur gears 64 to 69 and 72. The spur gears 64 to 69 are rotatably mounted on or secured to their respective shafts 61, 62, 63, with the latter case requiring the shafts to be rotatably carried in the corresponding bearing shells 53, 57 and 54, 58 and 55, 59.

However, it is also conceivable to rotatably carry the individual spur gears both on the shafts and in the bearing shells. The shaft 42 for the drive wheel 17 is rotatably carried in the bearing shells 56, 60. Axial securing of the shaft 42 is accomplished by the spur gear 72 which has its one side laterally located against the annular surface 84 of the casing shell 4 while its other side is located in axial direction against the end surface 86 of the bearing shell 60 of the mounting plate 41.

In FIG. 4, the electric motor 32 is centered in a sleeve 76 formed on the mounting plate 41, being secured to the mounting plate 41 through the plate member 44 by means of screws 78, 79 (FIG. 3). According to FIG. 4, the input shaft 70 extends in a bore 80 through the plate member 44 of the mounting plate 41. Formed laterally on the circumference of the sleeve 76 are two diametrically opposite resilient locking means 81, 87 operatively associated with corresponding recesses (not shown) provided in the casing shell 4.

The can opener of the invention is assembled as follows:

First, the individual shafts 61, 62, 63 with their spur gears as well as the output shaft 42 are inserted in the bearing shells 57, 58, 59 and 60. In a prior operation, the electric motor 32 was embedded in the sleeve 76 and fastened to the mounting plate 41 by means of screws 78, 79. Subsequently, the casing shell 4 is seated down on the assembly, such that the individual shafts 61, 62, 63 and the output shaft 42 engage into the respective bearing shells 53, 54, 55 and 56, while at the same time the output shaft 42 received within the bore 74 extends through the casing shell 4 to the outside. The mounting plate 41 is then fastened to the casing shell 4 by means of screws 50, 51 and 52 (FIG. 4).

The other components provided in the can opener 1 such as switch, accumulator (where a battery-operated can opener is used), socket, transformer (where a mains-operated can opener is used), etc. will not be dealt with in more detail, considering that they are not shown in the drawings and are not essential to the invention.

In a subsequent operation, the casing shell 3 is placed on the casing shell 4 until the parting lines 5, 6 are parallel to each other and the casing 2 is externally closed in this area. Then the casing shell 4 is brought into positive engagement with the casing shell 3 by means of the screw 14 (FIG. 2). The cap 10 is then seated onto the lower side of the two casing shells 3, 4 until is has reached the final position shown in FIG. 2. As this occurs, the locking means operatively associated with the two casing shells 3, 4 and not shown in the drawings retain the cap 10 in a fixed position on the casing 2.

In addition to closing the can opener 1 from the lower side, the cap 10 also serves the function of holding the lower part of the two casing shells 3, 4 together without additional threaded means.

We claim:

1. A hand-held can opener for severing a lid from a can, comprising an elongated casing that defines a longitudinal axis, a drive wheel mounted on a shaft for rotation about a drive wheel axis, a cutter blade which is adapted to pivot about a cutter blade axis parallel to said drive wheel axis for operative association with said drive wheel, said casing having a working surface from which both said cutter blade and said drive wheel project, an electric motor arranged in the interior of said casing and having an output shaft that drives said shaft of said drive wheel through a gear train, said gear train including a series of spur gears, said electric motor, said spur gears and said drive wheel shaft being arranged along said longitudinal axis of said casing, said output shaft of said electric motor, the shafts of said spur gears and said shaft of said drive wheel extending parallel to each other, and said longitudinal axis of said casing forming an angle (a) smaller than 90° with said shaft of said drive wheel.

2. The can opener as claimed in claim 1, wherein said angle (a) is 60°.

3. The can opener as claimed in claim 1, wherein in said working position of the can opener, the longitudinal axis of said casing extends parallel to the lid of the can, and said casing surrounding said spur gears and said electric motor forms at the same time the handgrip of the can opener.

4. The can opener as claimed in claim 3, wherein said casing is a cylindrical structure and said working surface is provided on the forward end of the can opener.

5. A hand-held can opener for severing a lid from a can comprising an elongated casing that defines a longitudinal axis, a drive wheel mounted on a shaft for rotation about a drive wheel axis, a cutter blade which is adapted to pivot about a cutter blade axis parallel to said drive wheel axis for operative association with said drive wheel, said casing having a working surface from which both said cutter blade and said drive wheel project, an electric motor in the interior of said casing and having an output shaft that drives said shaft of said drive wheel through a gear train, said gear train including a series of spur gears, said electric motor, said spur gears and said drive wheel shaft being arranged along said longitudinal axis of said casing, said output shaft of said electric motor, the shafts of said spur gears and said shaft of said drive wheel extending parallel to each other, and said longitudinal axis of said casing forming an angle (a) smaller than 90° with said shaft of said drive wheel, a mounting plate in said casing provided with a first set of bearing shells, said casing including a second set of bearing shells corresponding to said first set, the shafts of said spur gears having their one ends supported in said first set of bearing shells and their other ends supported in said second set of bearing shells, and means securing said mounting plate to said casing such that corresponding bearing shells are in relative alignment.

6. The can opener as claimed in claim 5, wherein said casing is comprised of two casing shells split in the longitudinal direction of the can opener, and said mounting plate is held clamped between the two assembled casing shells and fixedly secured in position.

7. The can opener as claimed in claim 6, wherein one of said casing shells includes said working surface and is provided with said second set of bearing shells.

8. The can opener as claimed in claim 5, wherein said mounting plate includes a sleeve integrally formed therewith, and said electric motor is centrally located on said mounting plate by means of said sleeve and is secured to said mounting plate by fastening means.

9. The can opener as claimed in claim 8, wherein said sleeve is adapted to lockingly engage into correspondingly formed recesses in said casing shell by means of locking means formed at its free end.

10. The can opener as claimed in claim 5 wherein said angle (a) is 60°.

11. The can opener as claimed in Claim 5, wherein in the working position of the can opener, said longitudinal axis of said casing extends parallel to the lid of the can, and said casing surrounding said spur gears and said electric motor forms at the same time the handgrip of the can opener.

12. The can opener as claimed in claim 11, wherein said casing is a cylindrical structure and said working surface is provided on the forward end of the can opener, said working surface being disposed at an angle (d) of about 30° to said longitudinal axis and said drive wheel axis being perpendicular to said working surface.

* * * * *